US007017626B2

(12) United States Patent
Giesselmann et al.

(10) Patent No.: US 7,017,626 B2
(45) Date of Patent: Mar. 28, 2006

(54) OIL FILLER NECK FOR AN INTERNAL-COMBUSTION ENGINE

(75) Inventors: Juergen Giesselmann, Markdorf (DE); Christian-Paul Stelzer, Tettnang (DE)

(73) Assignee: MTU Friedrichshafen GmbH, Friedrichshafen (DE)

( * ) Notice: Subject to any disclaimer, the term of this patent is extended or adjusted under 35 U.S.C. 154(b) by 135 days.

(21) Appl. No.: 10/777,176

(22) Filed: Feb. 13, 2004

(65) Prior Publication Data

US 2004/0159367 A1 Aug. 19, 2004

(30) Foreign Application Priority Data

Feb. 14, 2003 (DE) ..... 103 06 153

(51) Int. Cl.
*B65B 1/04* (2006.01)

(52) U.S. Cl. ..... 141/98; 141/331; 141/370; 141/379; 220/244; 220/246

(58) Field of Classification Search ..... 141/97, 141/98, 331, 340, 369, 370, 379; 220/243, 220/244, 86.2, 246; 184/1.5, 105.1
See application file for complete search history.

(56) References Cited

U.S. PATENT DOCUMENTS

| | | | | |
|---|---|---|---|---|
| 1,812,670 | A * | 6/1931 | Wahl | 220/86.2 |
| 1,822,201 | A * | 9/1931 | Cochrane | 123/41.33 |
| 2,531,860 | A * | 11/1950 | O'Neal, Jr. | 220/302 |
| 4,300,702 | A * | 11/1981 | Scharrer | 220/295 |
| 4,703,867 | A | 11/1987 | Schoenhard | |
| 5,316,059 | A * | 5/1994 | Lahnan et al. | 141/340 |
| 5,402,835 | A * | 4/1995 | Middleton | 141/331 |
| 6,223,923 | B1 * | 5/2001 | Fishman | 220/210 |
| 6,408,903 | B1 * | 6/2002 | Theuer et al. | 141/348 |

* cited by examiner

*Primary Examiner*—Timothy L. Maust
(74) *Attorney, Agent, or Firm*—Crowell & Moring LLP

(57) ABSTRACT

An oil filler neck assembly is provided for an internal-combustion engine, which includes a hinged lid and a lock. The lock, in turn, includes a rotating device and a fixing device. The rotating device is rotatably arranged in the lid. The fixing device is arranged in an oil feed opening. The lock can also be used at poorly accessible locations and causes a high sealing force.

16 Claims, 2 Drawing Sheets

OIL FILLER NECK FOR AN INTERNAL-COMBUSTION ENGINE

BACKGROUND AND SUMMARY OF THE INVENTION

This application claims the priority of Application No. 103 06 153.3 filed in Germany on Feb. 14, 2003, the disclosure of which is expressly incorporated by reference herein.

The invention relates to an oil filler neck for an internal combustion engine. Preferred embodiments of the invention relate to such an oil filler neck comprising a hinged lid which opens up a feed opening of an oil filler neck in a first position and closes the oil filler neck in a second position, and a lock for generating a sealing forced in the second position of the lid.

In the case of an internal-combustion engine, oil filler necks are used for the feeding of lubricants. When the oil filler neck is not in use, a feed opening is closed by means of a rotatable or hinged lid. From U.S. Pat. No. 4,703,867, an oil filler neck is known which has a hinged lid. In this case, the lid opens up the feed opening in a first position or closes the latter in a second position. In the second position, the lid is secured by means of a lock. This lock is constructed as a clip and is arranged on the exterior side of the oil filler neck. By way of the lock, a sealing force is additionally generated between the oil filler neck and the lid.

The problem in this case is the limited sealing force as well as the possibility of operating errors, that is, the possibility that the clip does not lock reliably into the lid.

It is an object of the invention to a design an oil filler neck which offers a high locking force and operating reliability.

This object is achieved according to certain preferred embodiments of the invention by providing an oil filler neck assembly for an internal-combustion engine comprising, a hinged lid which opens up a feed opening of an oil filler neck in a first position and closes the oil filler neck in a second position, and a lock for generating a sealing force in the second position of the lid, wherein the lock comprises a rotating device and a fixing device, the rotating device being rotatably arranged in the lid, and the fixing device being arranged in the feed opening, and wherein the rotating device and the fixing device are constructed to interact in the second position with the sealing force being generated by way of the rotation of the rotating device.

Further advantageous features of preferred embodiments of the invention are described herein and in the claims.

The invention provides that the lock comprises a rotating and fixing device. The rotating device is rotatably arranged in the lid. The fixing device is arranged in the feed opening of the oil filler neck. The rotating and fixing devices are constructed such that they interact in the second position and the sealing force is generated by way of the rotation of the rotating device. For this purpose, the rotating device has a lever with a jaw and pins arranged thereon. The fixing device comprises, among other things, a bush with a thread. In the second position, the pins engage in the thread of the bush. Therefore, by way of the rotation of the lever, the pins in the thread are also rotated, and a corresponding sealing force is thereby generated between the lid and the feed opening. The sealing force is defined by way of the pitch of the thread.

In addition to providing a high operating reliability, the lever additionally results in the advantage that the oil filler neck can also be used at inaccessible locations, for example, in the engine compartment of an armored vehicle. There is also the possibility of correspondingly retrofitting an internal-combustion engine with the oil filler neck according to the invention.

In a further development of the invention, it is provided that the fixing device comprises a spacer tube and a spring assembly in addition to the bush. By way of the spring assembly, the sealing forces are adjusted in a targeted manner. In addition, the spring assembly prevents an overstressing of the locking mechanisms and thus contributes to reducing the wear.

Other objects, advantages and novel features of the present invention will become apparent from the following detailed description of the invention when considered in conjunction with the accompanying drawings.

DETAILED DESCRIPTION OF THE DRAWINGS

Figure 2:
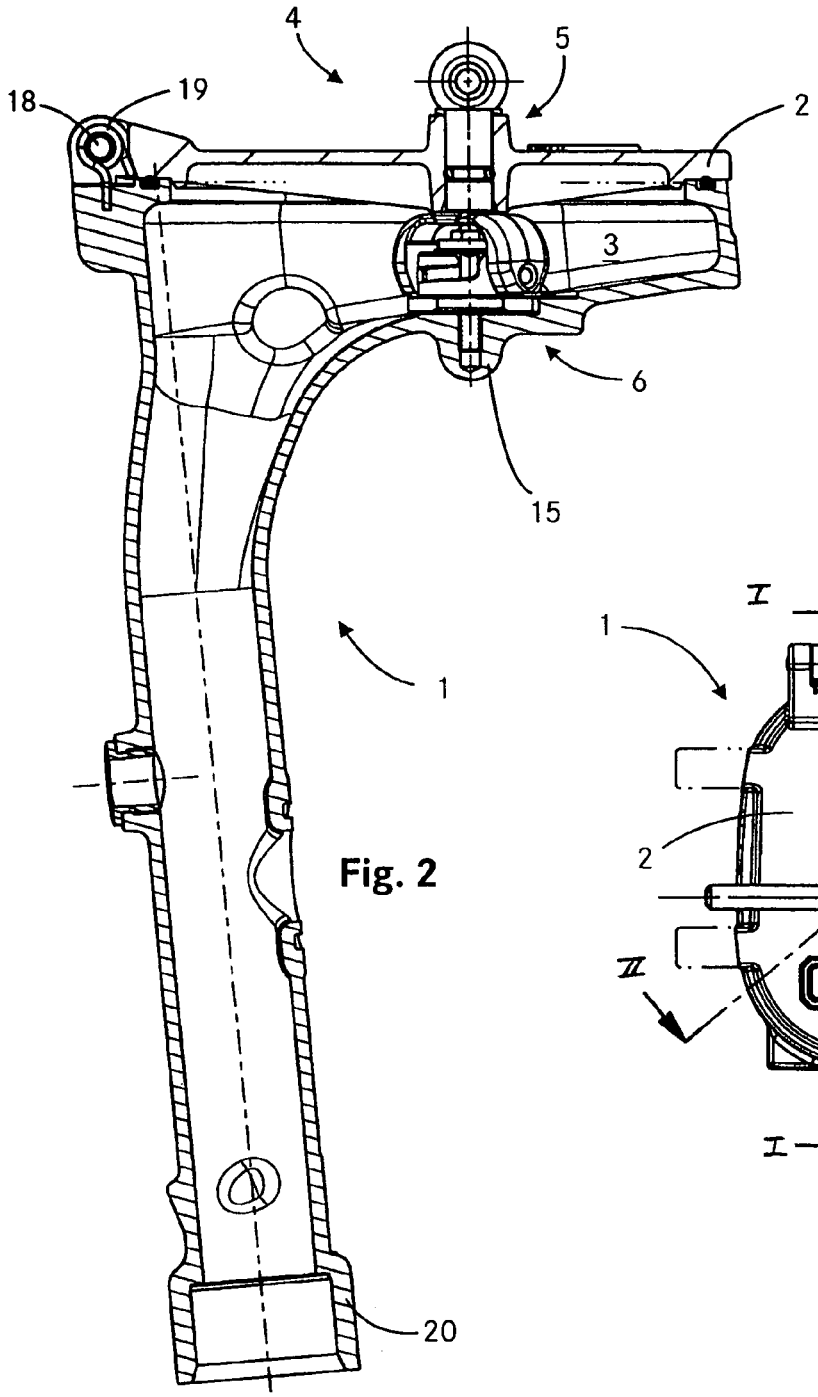
FIG. 2 is a sectional view taken along section I—I of FIG. 1.
Figure 1:
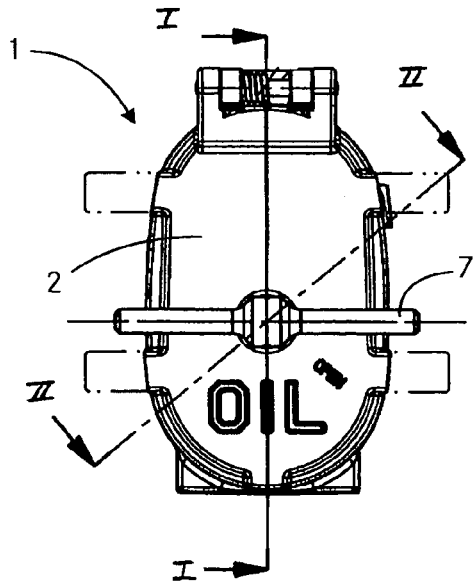
FIG. 1 is a top view of an oil filler neck assembly, constructed according to a preferred embodiment of the invention.

FIG. 1 is a top view of the oil filler neck 1. In this representation, a hinged lid 2 as well as a lever 7 are visible. The lever 7 is in the closed position; that is, the full sealing function is provided. FIG. 2 is a sectional view along Line I—I; and FIG. 3 is a sectional view along Line II—II.

FIG. 2 is a sectional view I—I of the oil filler neck 1. The filler neck 1 comprises a tube-shaped body with a feed opening 3, the lid 2 and a lock 4. The lid 2 can be hinged between a first position and a second position. In the first position, the feed opening 3 is opened up so that the lubricant can be fed. In the second position, the lid 2 closes the feed opening 3. So that the lid 2 can be swivelled, the latter is disposed by way of a straight pin 18 by means of a torsion spring 19 on the oil filler neck 1. The lock 4 comprises a rotating device 5 and a fixing device 6. The rotating device 5 is rotatably arranged in the lid 2 and is sealed off. The fixing device 6 is arranged in the feed opening 3 on a wall 15. The functional description of the lock 4 takes place in conjunction with FIG. 3. The oil filler neck 1 can be retrofitted; that is, an already existing oil filler neck can be replaced without any problem by the oil filler neck 1 according to the invention. A connecting part 20 is provided for this purpose.

Figure 3:
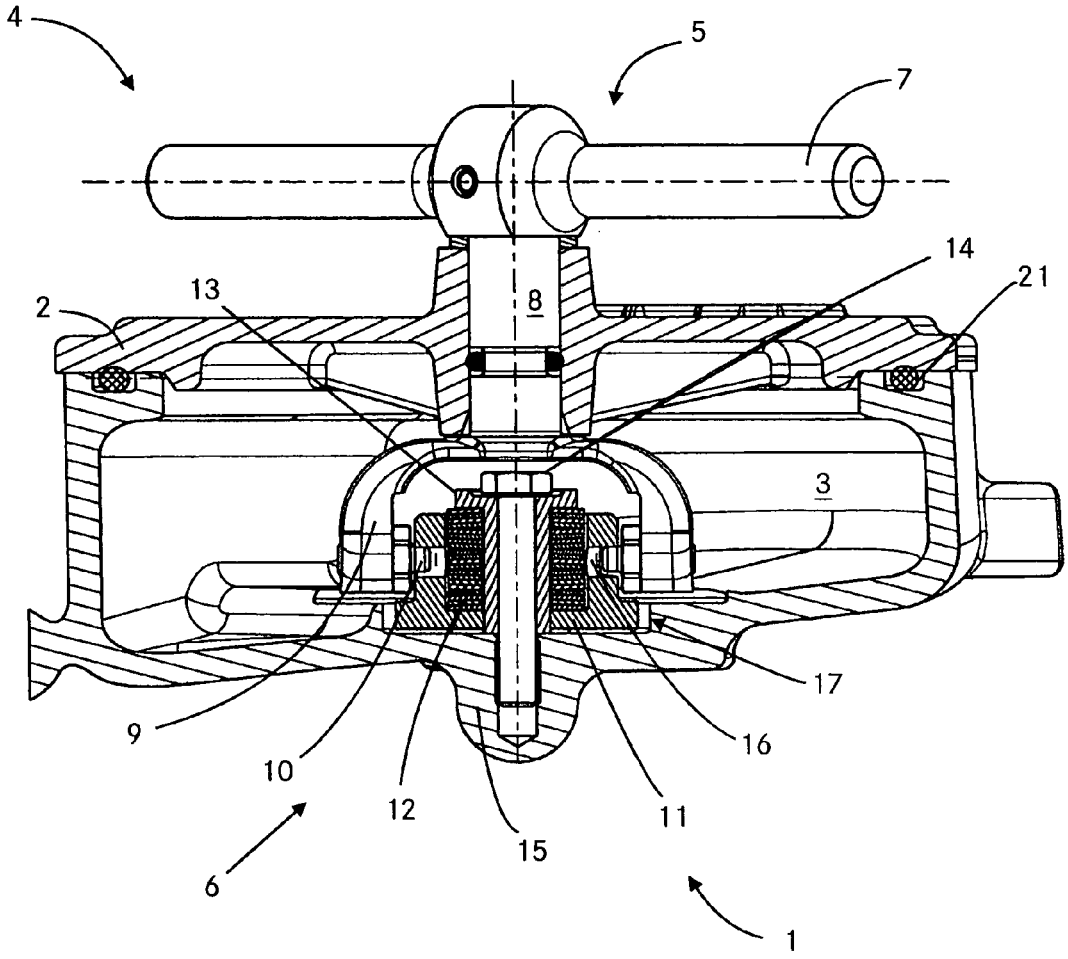
FIG. 3 is a sectional view taken along section II—II of FIG. 1.

FIG. 3 shows the oil filler neck 1 along the intersection line II—II of FIG. 1. The second position is illustrated here. The lock 4 comprises the rotating device 5 and the fixing device 4. The rotating device 5, in turn, includes the lever 7, a shaft 8 and a jaw 9. Two pins 10 are arranged on the curved jaw 9. The lever 7, the shaft 8 and the jaw 9 are non-rotatably connected with one another. By way of a rotation of the lever 7, the pins 10 are therefore also rotated in the same direction. The fixing device 6 comprises a bush 11 with a thread 16, a spring assembly 12 and a spacer tube 13. By way of a screw 14, the fixing device 6 is releasably connected with the wall 15 of the oil filler neck 1. In the area of the fixing device 6, the wall 15 has a contact surface 17. By means of the contact surface 17, it is prevented that the fixing device can rotate when loaded. The spring assembly 12 permits the axial displaceability of the bush 11.

The arrangement operates as follows: In the second position, the pins 10 engage in the thread 16 of the bush 11. By way of the manual rotation of the lever 7, the jaw 9 with the pins 10 is also rotated. As a result of the pitch of the thread 16, a sealing force between the lid 2 and the wall or an O-ring 21 is generated during the rotation of the rotating device 5. The sealing force is defined by way of the pitch of the thread 16 and the spring constant of the spring assembly 12. The spring assembly 12 additionally prevents the wear of the pins 10. In practice, the invention is constructed such that, when the lever 7 is rotated by 140 degrees, the full sealing function is ensured.

For unlocking, the lever 7 is manually rotated in an opposite unlocking rotational direction until the pins 10 disengage from the slot forming the thread 16 and the lid can then be pivoted to the open first position.

The invention has the following advantages:

The oil filler neck can be retrofitted;

the lever ensures a good accessibility and a high operating reliability;

by means of the form-locking pins/bush connection, a high sealing force is generated;

by way of the pitch of the thread and the spring constant of the spring assembly, the sealing force can be defined.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. Oil filler neck assembly for an internal-combustion engine comprising:

a hinged lid which opens up a feed opening of an oil filler neck in a first position and closes the oil filler neck in a second position, and a lock for generating a sealing force in the second position of the lid, wherein the lock comprises a rotating device and a fixing device, the rotating device being rotatably arranged in the lid, and the fixing device being arranged in the feed opening, and wherein the rotating device and the fixing device are constructed to interact in the second position of the lid with the sealing force being generated by way of the rotation of the rotating device.

2. Oil filler neck assembly according to claim 1, wherein the rotating device comprises a lever, a shaft, a jaw, and pins.

3. Oil filler neck assembly according to claim 1, wherein the fixing device comprises a bush, a spring assembly, and a spacer tube.

4. Oil filler neck assembly according to claim 3, wherein the bush has a thread and the pins engage in the thread in the second position.

5. Oil filler neck assembly according to claim 3, wherein the spring assembly is arranged between the bush and the spacer tube.

6. Oil filler neck assembly according to claim 3, wherein the fixing device is detachably connected with a wall of the feed opening.

7. Oil filler neck assembly according to claim 5, wherein the fixing device is detachably connected with a wall of the feed opening.

8. Oil filler neck assembly according to claim 6, wherein the wall has a contact surface as a protection against torsion for the bush.

9. Oil filler neck assembly according to claim 7, wherein the wall has a contact surface as a protection against torsion for the bush.

10. An oil filling assembly for an internal combustion engine comprising:

an oil filler neck with a fluid filling opening, a hinged lid supported at the neck and movable between a first position uncovering the fluid filling opening and a second position closing the fluid filling opening, and a lock assembly operable to sealingly lock the hinged lid when in the second closing position, wherein said lock assembly includes a rotatable drive carried by the hinged lid and a fixing device arranged on the filler neck adjacent the fluid filling opening, said rotatable device and fixing device being configured to operatively interact to apply sealing force to sealingly close the fluid filling opening upon rotation of the rotatable device when said lid is in the second closed position.

11. An oil filling assembly according to claim 10, wherein the rotating device includes a manually operable lever carried on the lid.

12. An oil assembly according to claim 11, wherein the rotating device includes a shaft connected with the lever and pins carried by the shaft.

13. An oil assembly according to claim 12, wherein the fixing device includes a threaded ramp slot engageable with the pins.

14. An oil assembly according to claim 13, wherein the fixing device includes a spring assembly.

15. An oil assembly according to claim 12, comprising an annular seal which in use, with the lid in the second closed position, surrounds the shaft.

16. An oil assembly according to claim 11, wherein the lever is no longer than a maximum width of the lid.

* * * * *